US010665920B2

(12) United States Patent
Sarkis et al.

(10) Patent No.: US 10,665,920 B2
(45) Date of Patent: May 26, 2020

(54) GLAZING PANEL HAVING AN ELECTRICALLY CONDUCTIVE CONNECTOR

(71) Applicants: AGC GLASS EUROPE, Louvain-la-Neuve (BE); ASAHI GLASS CO LTD, Chiyoda Ku (JP); AGC AUTOMOTIVE AMERICAS R&D, INC, Ypsilanti, MI (US)

(72) Inventors: Remi Sarkis, Louvain-la-Neuve (BE); Paul Schoebrechts, Gosselies (BE); Peter Schnoerch, Brussels (BE); Shoichi Takeuchi, Chiyoda Ku (JP); Naoki Hashimoto, Chiyoda Ku (JP)

(73) Assignees: AGC GLASS EUROPE, Louvain-la-Neuve (BE); AGC Inc., Chiyoda Ku (JP); AGC AUTOMOTIVE AMERICAS R&D, INC, Ypsilanti, MI (US)

( * ) Notice: Subject to any disclaimer, the term of this patent is extended or adjusted under 35 U.S.C. 154(b) by 64 days.

(21) Appl. No.: 15/570,241

(22) PCT Filed: Apr. 29, 2016

(86) PCT No.: PCT/EP2016/059654

§ 371 (c)(1),
(2) Date: Oct. 27, 2017

(87) PCT Pub. No.: WO2016/174228

PCT Pub. Date: Nov. 3, 2016

(65) Prior Publication Data

US 2018/0138575 A1 May 17, 2018

(30) Foreign Application Priority Data

Apr. 29, 2015 (EP) ..... 15165685

(51) Int. Cl.
*H01Q 1/32* (2006.01)
*H01Q 1/50* (2006.01)
(Continued)

(52) U.S. Cl.
CPC ..... *H01Q 1/1271* (2013.01); *H01Q 1/325* (2013.01); *H01R 4/023* (2013.01); *H01R 9/0515* (2013.01); *H01R 2201/02* (2013.01)

(58) Field of Classification Search
None
See application file for complete search history.

(56) References Cited

U.S. PATENT DOCUMENTS 5,078,619 A * 1/1992 Whittle ..... H01R 9/0518 439/578
5,603,636 A * 2/1997 Kanou ..... H01R 9/053 29/828
(Continued)

FOREIGN PATENT DOCUMENTS

EP 1 052 730 A1 11/2000
EP 1 592 095 A2 11/2005
(Continued)

OTHER PUBLICATIONS

International Search Report dated Jul. 28, 2016 in PCT/EP2016/059654 filed Apr. 29, 2016.

*Primary Examiner* — Trinh V Dinh
(74) *Attorney, Agent, or Firm* — Oblon, McClelland, Maier & Neustadt, L.L.P.

(57) ABSTRACT

Glazing panel having an electrically conductive connector. A glazing panel comprising (i) a pane of glass, (ii) an antenna, (iii) an electrically conductive connector joined to the antenna by a lead-free solder material, and (iv) a coaxial cable joined to the electrically conductive connector.

16 Claims, 4 Drawing Sheets

(51) Int. Cl.

| | |
|---|---|
| ***H01Q 1/12*** | (2006.01) |
| ***H01R 9/05*** | (2006.01) |
| ***H01R 4/02*** | (2006.01) |

(56) References Cited

U.S. PATENT DOCUMENTS

| | | | | |
|---|---|---|---|---|
| 6,065,998 | A * | 5/2000 | Peloza | H01R 9/0518 439/108 |
| 6,372,990 | B1 | 4/2002 | Saito et al. | |
| 7,029,321 | B2 * | 4/2006 | Sato | H01R 9/0515 439/516 |
| 9,941,606 | B1 * | 4/2018 | Hashimoto | H01R 9/0515 |
| 2005/0245129 | A1 | 11/2005 | Sato et al. | |
| 2005/0248129 | A1 * | 11/2005 | Pelchat | A63C 5/128 280/629 |
| 2009/0035990 | A1 * | 2/2009 | McCarthy | H01R 9/0518 439/585 |
| 2018/0258683 | A1 * | 9/2018 | Wellman | E05F 15/655 |

FOREIGN PATENT DOCUMENTS

| | | | |
|---|---|---|---|
| GB | 2 244 870 | A | 12/1991 |
| WO | 2015/023921 | A1 | 2/2015 |

* cited by examiner

GLAZING PANEL HAVING AN ELECTRICALLY CONDUCTIVE CONNECTOR

TECHNICAL DOMAIN OF THE INVENTION

The present invention relates to glazing panel, which comprises connector, in particular electrically conductive connector. More particularly, the present invention relates to a vehicle glazing, which comprises electrically conductive connector connected to an antenna, for example a coaxial cable connected to an antenna by an electrically conductive connector.

BACKGROUND OF THE INVENTION

Glazing panels in motor vehicles today have a number of additional electrical devices such as an antenna, glazing panel heater, and the like.

Through the introduction of an electrically functional component or an electrically functional layer coupled with a glazing panel, automotive glazing can be provided with various functions. The electrically functional components are, for example, antenna elements, solar cells or electrochromic coatings. Through insertion of thin metal wires or application of an electrically heatable coating, a heating function can be obtained. These electrically functional component or layer need to be connected for example to a power source or to an amplifier thanks to at least an electrically conductive connector. The electrical connectors are attached before the glazing panel is installed in the motor vehicle.

The attachment to a glazing panel occurs in that an electrically conductive connector provided with solder material is placed on the contact surface of the glazing panel and is then heated so that the solder material melts with the contact surface of the glazing panel.

Traditionally, the connectors are soldered to an electrically functional component or an electrically functional layer with a lead-based solder material because lead is a deformable metal and minimizes mechanical stress between the connector and the substrate due to difference of thermal expansion of the connector and the substrate resulting from changes in temperature. More specifically, differences in coefficients of thermal expansion between the connectors, which are typically made of a good conductive material such as copper, and the substrates cause the mechanical stress. In case of a glass substrate, such stress may result in cracking or other damage to the substrate, which is typically made of glass. Lead-based solder material, typically comprises tin (Sn) and lead (Pb). The lead decreases the radical reaction rate between tin in the solder and the electrically functional component or the electrically functional layer, generally consisting of a high silver (Ag) content, allowing for good solderability. However, it is known that lead may be considered an environmental contaminant. Thus, there is a motivation in many industries, particularly the automotive industry, to move away from all uses of lead in vehicles. On top of that, the EU legislation, e.g. the current "End of Life" Vehicle Directive (ELV Directive) 2000/53/EC prohibits certain hazardous substances such as lead. The main impetus for the industry to leave lead behind is a ban on lead in electronics imposed by the European Union. Under the Restriction of Hazardous Substances directive, as of 1 Jul. 2006 lead must be replaced by other substances in electronic equipment. (The directive also bans mercury, cadmium, and hexavalent chromium.) Any electronic components bound for Europe are subject to the ban.

The use of lead-free solder materials is common in the microelectronics and plumbing industries. Such materials are for example described in EP0704727B1 and U.S. Pat. No. 4,758,407B which are representative patents from each of these respective industries.

The use of lead-free solder materials is expanding into other industries, including the automotive industry. Such use is for example described in US publication US20070224842A1.

Conventional solder materials have been proposed to replace the lead in the solder material. Such materials comprise commonly a high level of tin, along with small amounts of silver, copper, indium and bismuth. However, such materials increase radical reaction rates between the tin-rich solder material and the silver of or added to the electrically functional component or the electrically functional layer, resulting in poor solderability. These conventional materials do not absorb the mechanical stress between the connector and the substrate due to thermal expansion of the connector and the substrate resulting from changes in temperature, which tends to crack or otherwise damage the substrate. Further, many alternative materials for the connector are difficult to solder, making it difficult to sufficiently adhere the connector to the electrically functional component or the electrically functional layer such as antenna on the substrate. As a result, other techniques would be required in order to sufficiently adhere the alternative materials to the electrically functional component or the electrically functional layer such as antenna on the substrate.

For example, U.S. Pat. No. 6,253,988 discloses solder material compositions including high amounts (or large amounts) of indium due to a low melting point, malleability, and good solderability to the electrically functional component or the electrically functional layer. However, solder material compositions including indium may have very soft phases, and the solder material compositions exhibit poor cohesive strength under stress. Because these other conventional materials are insufficient, there is a need, particularly, to find an electrically conductive connector soldered with a lead-free solder material.

The present invention relates to a glazing panel more particularly a vehicle glazing comprising an electrically functional component or an electrically functional layer linked through an electrically conductive connector. A such electrically functional component or electrically functional layer is for example an antenna.

An antenna is an electrical device which converts electric power into radio waves, and vice versa. It is usually used with a radio transmitter or radio receiver. In transmission, a radio transmitter supplies an electric current oscillating at radio frequency (i.e. a high frequency alternating current (AC)) to the antenna's terminals, and the antenna radiates the energy from the current as electromagnetic waves (radio waves). In reception, an antenna intercepts some of the power of an electromagnetic wave in order to produce a tiny voltage at its terminals that is applied to a receiver to be amplified.

Antennas are essential components of all equipment that uses radio. They are used in systems such as radio broadcasting, broadcast television, two-way radio, communications receivers, radar, cell phones, and satellite communications, as well as other devices such as garage door openers, wireless microphones, Bluetooth-enabled devices, wireless computer networks, baby monitors, and RFID tags on merchandise.

Typically, an antenna consists of an arrangement of metallic conductors, electrically connected (often through a transmission line) to the receiver or transmitter. An oscillating current of electrons forced through the antenna by a transmitter will create an oscillating magnetic field around the antenna elements, while the charge of the electrons also creates an oscillating electric field along the elements.

In the automotive field, antennas are used to send and/or to receive information such as radio, TV or cell phone signals (GSM) but also to communicate with the vehicle, i.e. to be able to open car doors without having to insert the key, with other vehicles, i.e. to keep a distance between to vehicle, or with the environment, i.e. tolls, traffic lights, . . . .

Antennas may be assembled within the glazing, i.e. windshield, backlite, sidelite or sunroof or fixed in the carbody, such as roof. There are different antenna systems used in a vehicle.

The antenna size is usually fraction of the wave length ($\lambda$) of its operating frequency, typically $\lambda/2$ or $\lambda/4$. Additionally, the presence of neighbor dielectric medium reduces the dimension of the radiator by a factor of $\sqrt{\in_r}$ where $\in_r$ is the relative permittivity of dielectric material.

Modern cars may contain multiple antennas for analog audio broadcasts (amplitude modulated (AM—0.5-1.7 MHz) and frequency modulated (FM—76-108 MHz), global positioning system (GPS—1575 MHz) data, cellular phone communication, e.g. global system for communication (GSM—800/1800 MHz), long term evolution (LTE—800/1800/2600 MHz), digital audio broadcasting (DAB—170-240 MHz), remote keyless entry (RKE—315/433 MHz), television reception, tire pressure monitor system (TPMS—315/433 MHz), automotive radar (22-26 GHz/76-77 GHz), car to car communication (C2C—5.9 GHz), etc.

A first system is well-known and described in U.S. Pat. No. 8,519,897B2. Low-profile antenna assembly or Shark fin type car antenna assembly, are configured for using with AM/FM radio, satellite digital audio radio services (SDARS), global positioning systems (GPS), digital audio broadcasting (DAB)-VHF-III, DAB-L, Wi-Fi, Wi-Max, and cell phones. In some example embodiments, the antenna assemblies include at least two antennas co-located, for example, on common chassis of the antenna assemblies, under common covers of the antenna assemblies. Such antennas are commonly placed on roofs, hoods, or trunks of automobiles to help to ensure that the antennas have unobstructed views overhead or toward the zenith.

A second well-known system is backlite antenna system utilizing defogger elements already encapsulated in the back window of the vehicle as antenna elements to receive the AM and FM broadcasts. Examples of such backlite antenna systems can be found in U.S. Pat. No. 5,293,173 or in U.S. Pat. No. 5,099,250. For the known combination defogger/antenna element systems embedded in rear windows of vehicles, it has been necessary to incorporate two bifilar or toroidal chokes between the elements and the vehicle DC power supply so as to separate the antenna signals from the high current signals that heat the elements.

A third system is well-known and described in US publication US2014104122A1. This system consists of a window assembly with an antenna element including wire or transparent coating disposed within the glazing. This type of antennas is generally configured to receive linearly polarized radio frequency (RF) signals. Specifically, the linearly polarized RF signals which the antenna element may receive, in a non-limiting manner, AM, FM, RKE, DAB, DTV and cell phone signals.

With the evolution of technologies, vehicles are equipped with a lot of antennas to be able to communicate (receiving or emitting information). Some are fixed on the carbody, others are placed on the glazing panels of glass.

Classical automotive broadcast low frequency antennas placed on glass (the second or the third type of antennas) are electrically fed, powered and connected by a single element as described in the PCT publication WO2004068643.

Classically, this element is physically and electrically connected to the antenna by a single crimp soldered within an area of silver print. For example, a 10 mm by 10 mm silver print area is printed on a backlite and is linked to a wire antenna. The element could be a wire, a pigtail, a copper line or a MQS flat cable connected to an active amplifier.

The soldering of this type of antennas is not critical as long as it fits inside, the said predefined area and has no impact on the functionality and performance of these low frequency antennas since it is a small fraction of their wavelength.

In the case of higher frequency systems, so with much shorter wavelength, two problems appear.

The first problem is due to the single wire line. A single wire line is not suitable to transport the signal and to receive the power and waves. For efficient power transmission and transportation at higher frequencies, a coaxial cable is needed. The said coaxial cable corresponds to an assembly comprising a central metallic thin line or central pin, conductor, coming through, inside a cylindrical dielectric plastic material, that is also covered by a cylindrical metallic shield, metallic grid as a ground plane. This assembly is covered finally by an insulating layer. The signal, wave, voltage, current, will circulate between the central pin and the metallic shield of the coaxial cable.

Generally, antenna for these high frequencies comprises at least two parts which are connected to the coaxial cable. The metallic shield of the coaxial cable is connected to the first part of the antenna (for example the ground) and the central pin is connected to the second part of the antenna in such a way to receive or transmit an electrical potential difference, voltage between these two parts of the antenna.

The second problem is due to the soldering. Antennas at higher frequency have small wavelength. So the precision of the soldering at higher frequency is or may be strict since even small fluctuations are still comparable to the wavelength.

For these reasons, wideband antennas need to be connected to a specific cable such as a coaxial cable. This coaxial cable needs to be connected on one hand to the ground of the antenna and on the other hand to the second part of the antenna. For that, the cable is connected to the antenna via a connector that connects the metallic shield of the coaxial cable to the ground of the antenna and also allows the central pin to be connected to the other part of the antenna.

The following description relates to an automotive glazing but it's understood that the invention may be applicable to others fields like architectural glazing which may provide electrically functional component or an electrically functional layer coupled with a pane of glass.

SUMMARY OF THE INVENTION

The invention relates to a glazing panel comprising a pane of glass, an antenna, an electrically conductive connector joined to the antenna by a lead-free solder material, and a coaxial cable which comprises at least a pin and a shield separated by a dielectric element and protected by an insulated layer. The electrically conductive connector comprises at least two mechanical fixing elements for maintaining the coaxial cable to the electrically conductive connector.

More particularly, the invention relates to a vehicle glazing panel which comprises a pane of glass, an electrically conductive connector connected to an antenna, for example a coaxial cable connected to an antenna by an electrically conductive connector.

The pane of glass can be a flat or curved panel to fit with the design of the car. The pane of glass can be tempered to respect with the specifications of security. A heatable system, for example a coating or a network of wires, can be applied on the pane of glass to add a defrosting function for example. Also, the pane of glass can be a clear glass or a colored glass, tinted with a specific composition of the glass or by applying a coating or a plastic layer for example.

According to the invention, a glazing panel comprises at least an antenna that is, preferably, a wideband antenna to receive and/or transmit information through a higher frequencies, for example a LTE network (4G). The antenna is preferably a printed antenna. The wideband antenna is, preferably, working with a frequency band between 700 MHz and 3 GHz.

According to the invention, the glazing panel may comprise some other antennas like AM, FM, RKE, DAB, DTV antennas or other type of antennas to add antenna functions to the glazing panel.

According to the invention, the coaxial cable is a cable designed to allow carrying higher frequency signals better than a cable used for automotive antenna placed on glass and comprises at least a pin and a shield separated by a dielectric element and protected by an insulated layer.

Preferably, the metallic shield of coaxial cable is extended near the intermediate conductive element which is crimped to the central pin designed to maintain the specific impedance that cable allows to carry higher frequency signal (usually a specific value of impedance of 50 Ohms as transmittance cable/line for high frequency). Thus, the metallic shield is close to the intermediate conductive element reducing the distance between the intermediate conductive element carrying on the central pin and the metallic shield.

More preferably, the extension region of the metallic shield is covered by insulated layer such as a heat shrinkable tube to not electrically connect to the second part of the antenna.

Thus, thanks to the shield extension, the loss in high frequency is reduced and allow to improve performances of the antenna since without this extension, the impedance may change and then it will occur some refection on the portion of the impedance change leading to a transmittance loss.

According to the invention, the electrically conductive connector connects an antenna to the cable and is joined to the antenna by a lead-free soldering to respect the EU regulation.

The electrically conductive connector material is a material selected to have difference of thermal expansion of the glazing panel and the electrically conductive connector material less than 5×10-6/° C.

According to the invention, the connector may be made with different type of materials such as Copper, Chromium alloys, Steel alloys such stainless steel alloys, steel alloys with a high amount of Chromium or Nickel or any other materials or alloys that fit with constraints of the connector functions such as to be connected to an antenna, to be able to fix a cable, and other advantages of this kind of materials or alloys.

Preferably, the solder material has improved characteristics at temperature greater than 150° C. Such solder material is known from DE102006047764A1. A such lead-free solder material is based on a solder alloy of Sn, Ag, comprising between 88% and 98.5% Sn by weight, between 0.5 and 5% Ag by weight or Bismuth-Tin-Silver (Bi—Sn—Ag) alloys. Preferably, the soldering material has the following alloys, at least as components thereof BixSnyAgz where x, y, z represents the percentage by weight of the component (this nomenclature is well-known): Bi57Sn42Ag0, Bi57Sn40Ag3, SnAg3.8Cu0.7, Sn55Bi44Ag1, or SAC alloys (Tin-Silver-Copper (Sn—Ag—Cu) alloys). More preferably, the solder alloy is a SAC305, consisting of 3% Ag by weight, 0.5% Cu by weight and 96.5% Sn by weight. This solder material improved bonding characteristics for the connectors used therewith, as well as high fatigue strength.

According to the invention, the connector element preferably consists of an iron-nickel (FeNi) or iron-chromium (FeCr) alloy, or a mixture thereof. More preferably, the connector element preferably consists of FeCr10, FeCr16, a Grade 430, FeNi42, FeNi48 or FeNi52.

Due to the high frequency used, the connection between the antenna and the cable has to be very precise to limit the distortion of the signal. In order to fulfill this condition, the connector comprises at least two mechanical fixing elements. These mechanical fixing elements allow maintaining the cable in the right place avoiding movements of the cable and ensure having a good electrical connection to the antenna. These elements may have a different composition than the connector. Preferably, the shield is connected to the antenna via at least one of the mechanical fixing element to have a very good electrical connection to the antenna.

According to the invention, the central pin is preferably connected to the antenna by a lead-free soldering separately from the electrically conductive connector. The central pin may be preferably crimped into an intermediate conductive element. In this case, the lead-free solder material is provided between the intermediate element and the antenna.

According to the invention, the electrically conductive connector preferably comprises at least an extended region for fixing mechanical fixing elements and at least one foot connected to the extended region for joining to the antenna by a lead-free solder material Those two parts meaning at least one foot and an extended region allow to facilitate the soldering of the connector to the antenna and the fixing of the cable. According to the invention, the extended region is the region that is not directly in contact with the antenna but electrically connected to the antenna through the foot. Preferably, the shape of the extended region may be a rectangular part, curved or not, or any other shapes. The foot is in contact with the antenna through the solder material. Preferably, the electrically conductive connector comprises at least one foot with a rounded shape. It is understood that the rounded shape term means any form with a general rounded shape like, in a non-limiting manner, an oval shape, an ovoid shape, an circle shape, a semi-circle shape, a clover shape, a multi-circles shape, a polyhedron like for example a part of a circle with cut edges, or a rectangular shape with rounded edges, like a rectangular with rounded corners. It could also be a single ring shape.

More preferably, the electrically conductive connector comprises two feet to have stability during the process of mounting the connector on the antenna and to stabilize the cable during the life of the glazing panel by avoiding any movement of the cable.

According to the invention, the electrically conductive connector comprises at least a part of the extended region provided between feet. When an at least a part of the extended region provided between feet, the shape of the extended region is a U-shape or a T-shape. A U-shape means a kind of bridge connecting the two feet. A T-shape means a kind of a bridge with a substantially perpendicular portion. The advantage of this kind of shapes is to have a symmetrical connector with a high stability.

According to the invention, mechanical fixing elements are provided to maintain the cable to the connector. They are preferably fixed to the extended region. Preferably, mechanical fixing elements are crimping elements to crimp the cable to the connector in order to reduce the process timing and avoid movement of the cable after the crimping step.

Preferably, mechanical fixing elements have the same composition than the extended region and may have been manufactured in the same piece than the extended region.

More preferably, to avoid deformation of the extended region due to the mechanical fixing of the cable, mechanical fixing elements are fixed to at least one edge of the extended region of the electrically conductive connector.

More preferably, to eliminate any fluctuation of behavior due to unstable coaxial cable connection with the extended region, mechanical fixing elements are fixed to opposite edge of the extended region of the electrically conductive connector.

In one embodiment of the present invention, the electrically conductive connector comprises three mechanical fixing elements; two of the mechanical fixing elements are electrically connected to the shield of the coaxial cable and are fixed to opposite edge of the extended region of the electrically conductive connector and one of the mechanical fixing elements is fixed to the insulated layer of the coaxial. This feature allows to ensure the electrical connectivity and to eliminate any fluctuation of behavior due to unstable coaxial cable connection with the extended region.

The present invention relates also to a connector comprising at least two mechanical fixing elements for maintaining the coaxial cable to the electrically conductive connector.

According to the invention, the connector preferably comprises at least an extended region for fixing mechanical fixing elements and one foot connected to the extended region for joining to the antenna by a lead-free solder.

According to the invention, the connector preferably comprises two feet.

According to the invention, the connector preferably comprises mechanical fixing elements which are fixed to at least one edge of the extended region of the electrically conductive connector.

The advantages of the connector are the same as those of a glazing panel according to the invention comprising such a connector and will not be explained in more detail.

FIGURES

The present invention will now be more particularly described with reference to drawings and exemplary embodiments, which are provided by way of illustration and not of limitation. The drawings are a schematic representation and not true to scale. The drawings do not restrict the invention in any way. More advantages will be explained with examples.

Figure 1:
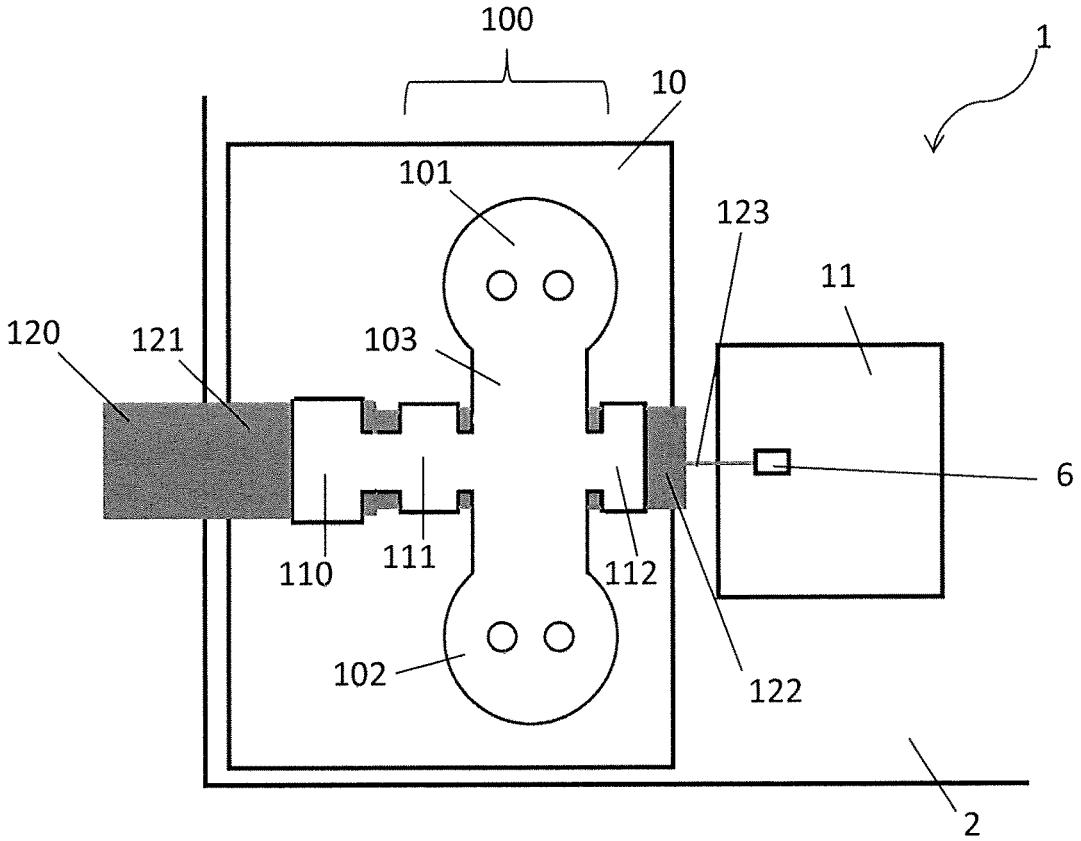
FIG. 1 is a plan view of a first embodiment of the glazing panel according to the invention.
Figure 2:
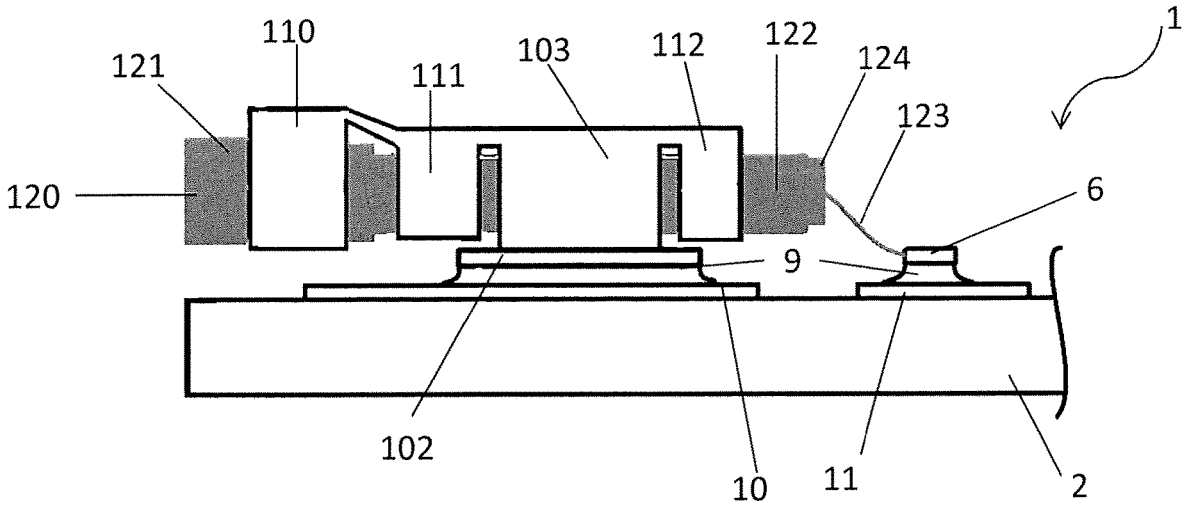
FIG. 2 is a side view of a first embodiment of the glazing panel according to the invention.

Referring to the FIG. 1 and FIG. 2 according to a first embodiment of this invention, a glazing panel 1 includes a pane of glass 2 carrying a printed wideband antenna 10, 11. An electrically conductive connector 100 comprising two feet 101, 102 and a U-shaped extended region 103 is electrically connected to a first part of the antenna 10 through a soldering material 9. For example, the electrically conductive connector 100 is made of a GRADE430 (Fe, <0.12% C, 16-18% Cr, <0.75% Ni, <1.0% Mn, <1.0% Si, <0.040% P, <0.030% S) material and the soldering material 9 is made of a SAC305 material.

Three mechanical fixing elements 110, 111, 112 are fixed to the extended region 103 and maintain a coaxial cable 120. The coaxial cable 120, comprising a central pin 123 and a shield 122 separated by a dielectric 124, the shield 122 protected by an insulated layer 121 which surrounds the coaxial cable and may be a plastic material, is crimped by the three mechanical fixing elements 110, 111, 112. In this embodiment, the mechanical fixing elements 110 crimps the cable 120 and is in contact with the insulated layer 121. This mechanical fixing element 110 handles most of all the tension and provided rigidity needed. The two others mechanical fixing elements 111, 112 crimp the cable and are in contact with the shield 122. These two others mechanical fixing elements 111, 112 are fixed in the opposite edges of the extended region 103 of the electrically conductive connector 100. The third mechanical fixing elements 112 after the extended region allows to ensure the electrical connectivity and eliminates any fluctuation of behavior due to unstable coaxial cable connection with the extended region. The central pin 123 of the coaxial cable 120 is crimped to an intermediate conductive element 6. This intermediate conductive element 6 is electrically connected by a solder material 9 to the second part of the antenna 11. The central pin 123 and an intermediate conductive element 6 are crimped and soldered for keeping the same shape and characteristic for each operation in order to obtain a stable performance.

The soldering process of the electrically conductive connector 100 and the central pin 123 and intermediate conductive element 6 should be compatible with a soldering head for electrical heating soldering and lead-free application in case of lead-free solder material.

One other important aspect of the present invention is that the coaxial cable 210 is crimped to the downside area of the extended region 103 in order to stay as close as possible to the glass to allow the soldering of the central pin 123 with a minimum bending of the central line. Thus, a better repeatability of the soldering with the same position, precision, electrical, performance is obtained. Otherwise, the curvature of the central pin will change the coaxial design and add losses and inefficient transmission modes.

The coaxial cable 120 fixed to the downside may be in direct contact or not with the surface of the pane of glass. However for industrial reasons, preferably a minimum distance between the coaxial cable and the surface of the pane of glass is in order to avoid any possible stress point at the glass after soldering and to limit the curvature of the central pin.

Figure 3:
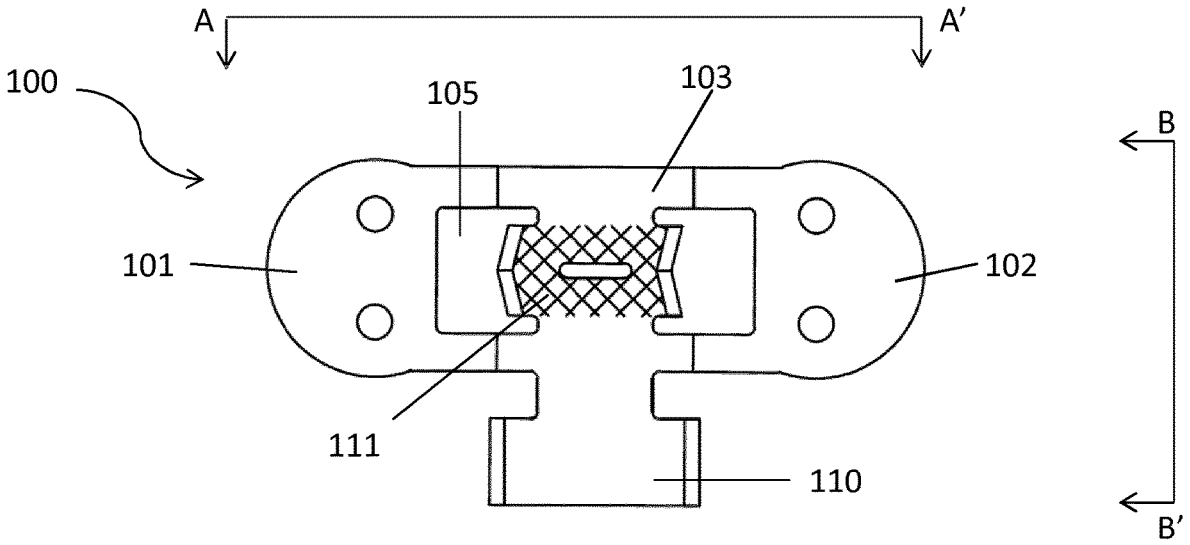
FIG. 3 is a plan view of an embodiment of an electrically conductive connector according to the invention.
Figure 4:
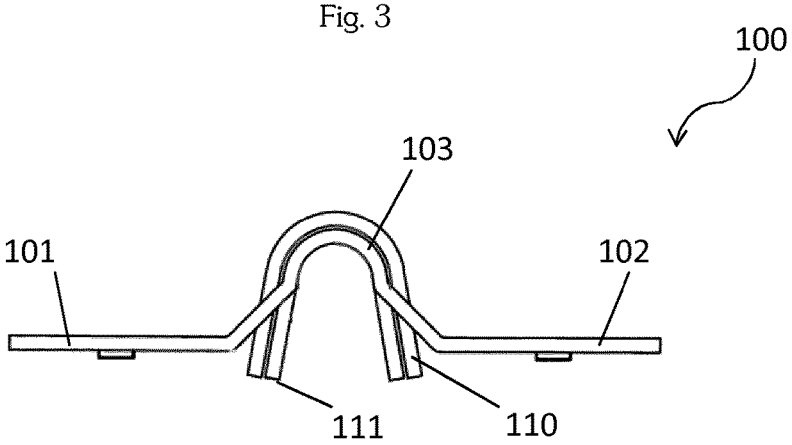
FIG. 4 is a side view from A-A' of an embodiment of an electrically conductive connector according to the invention.
Figure 5:
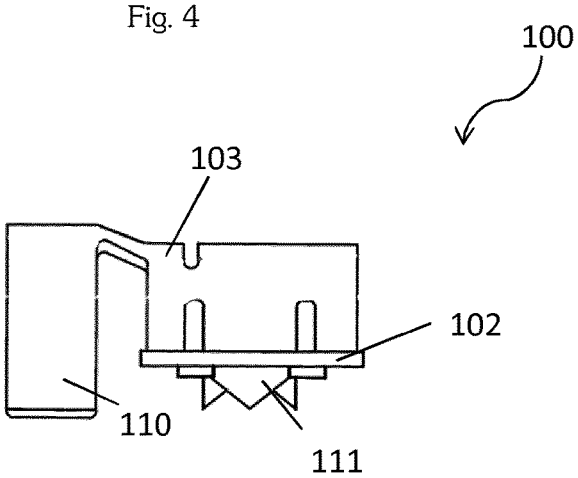
FIG. 5 is a side view from B-B' of an embodiment of an electrically conductive connector according to the invention.

Referring to the FIG. 3 to FIG. 5, according to an embodiment of an electrically conductive connector according to the invention, the electrically conductive connector 100 comprises a U-shaped extended region 103 between two feet 101,102. Two mechanical fixing elements 110, 111 are fixed to the extended region 103. A first mechanical fixing element 110 is fixed on one edge of the extended region 103 and is able to crimp the insulated layer of a coaxial cable. A second mechanical fixing element 111 is fixed on the extended region 103 and preferably on a recess 105 of the extended region 103 and is able to crimp the shield of a coaxial cable.

Figure 6:
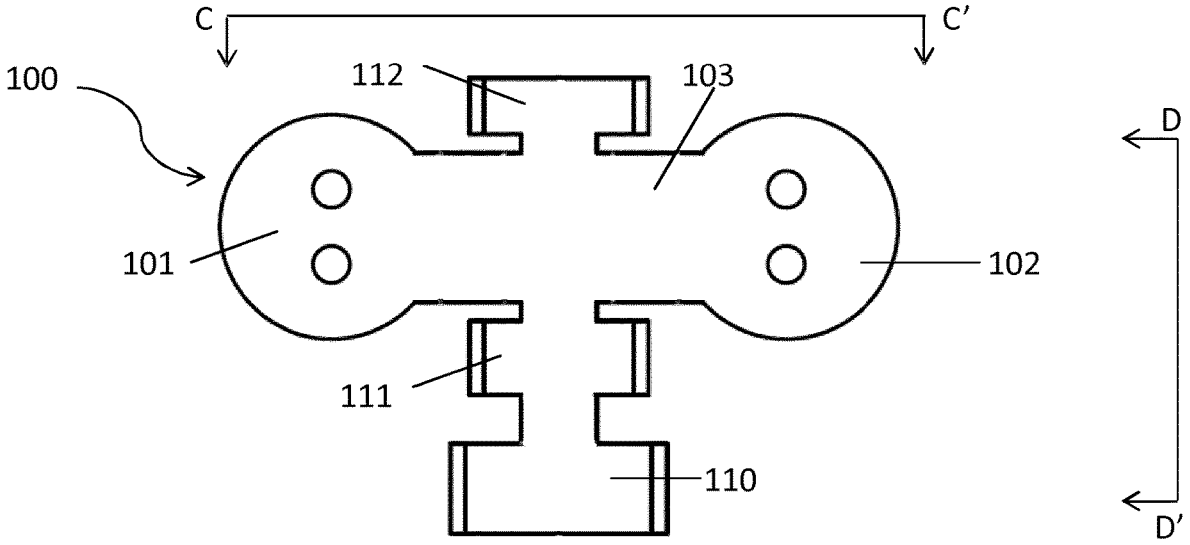
FIG. 6 is a plan view of another example of an electrically conductive connector according to the invention.
Figure 7:
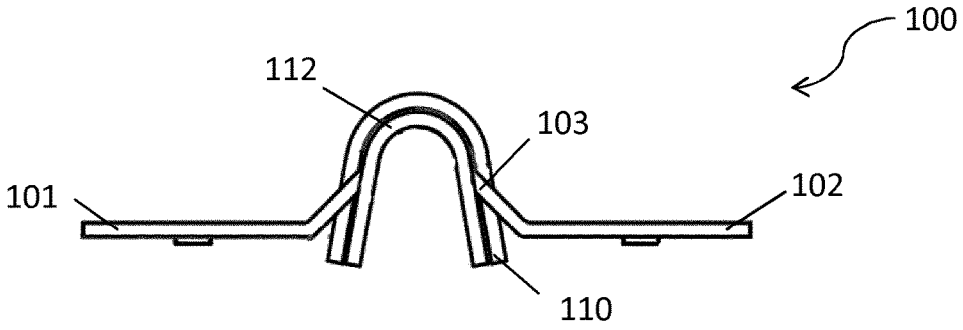
FIG. 7 is a side view from C-C' of another example of an electrically conductive connector according to the invention.
Figure 8:
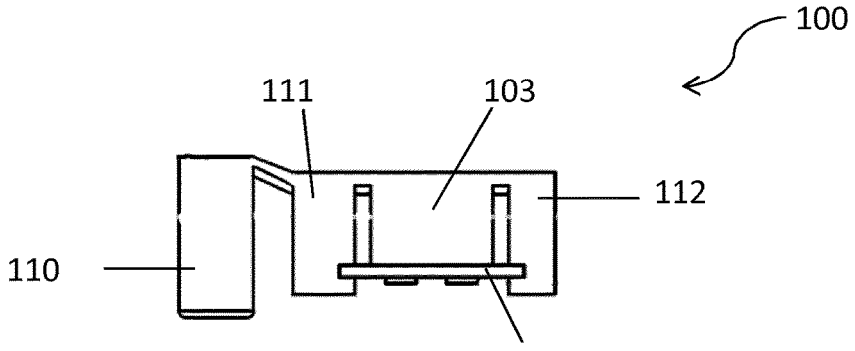
FIG. 8 is a side view from D-D' of another example of an electrically conductive connector according to the invention.

Referring to the FIG. 6 to FIG. 8, according to another example of an electrically conductive connector according to the invention, the electrically conductive connector 100 comprises a U-shaped extended region 103 between two feet 101, 102. The electrically conductive connector 100 comprises two mechanical fixing elements 111, 112 that are fixed in the opposite edges of the extended region 103 and are able to crimp the shield of a coaxial cable. The electrically conductive connector 100 comprises also a third mechanical fixing element 110 that is fixed after one of the two first mechanical fixing elements 111, 112 and is able to crimp the insulated layer of a coaxial cable.

Figure 9:
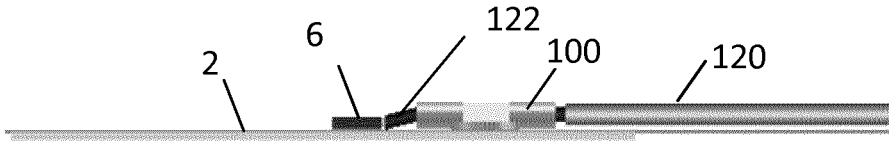
FIG. 9 is a side view representing the extension of the metallic shield according to one embodiment of the present invention.

According to one embodiment of the present and as shown in FIG. 9, the coaxial cable may be present an extension of the metallic shield 122 in order to be closer to the intermediate conductive element crimping the central pin. Thus, thanks to the shield extension, the loss in high frequency is reduced and allow to improve performances of the antenna since without this extension, the impedance may change and then it will occur some refection on the portion of the impedance change leading to a transmittance loss.

More preferably, the extension region of the metallic shield is covered by insulated layer such as a heat shrinkable tube to not electrically connect to the second part of the antenna.

The invention claimed is:

1. A glazing panel comprising:
- a pane of glass,
- an antenna,
- an electrically conductive connector joined to the antenna by a lead-free solder material, and
- a coaxial cable which comprises at least a pin and a shield separated by a dielectric element and an insulated layer protecting the shield,
- wherein the electrically conductive connector further comprises
  - first, second, and third mechanical fixing elements for maintaining the coaxial cable to the electrically conductive connector,
  - at least an extended region for fixing mechanical fixing elements,
  - at least one foot connected to the extended region for joining to the antenna by the lead-free solder material, and
  - the first and second mechanical fixing elements being electrically connected to the shield of the coaxial cable and fixed to opposite edges of the extended region of the electrically conductive connector and the third mechanical fixing element fixed to the insulated layer of the coaxial cable.

2. The glazing panel as claimed in claim 1, wherein the electrically conductive connector comprises two feet.

3. The glazing panel as claimed in claim 1, wherein at least one foot has a rounded shape.

4. The glazing panel as claimed in claim 1, wherein the mechanical fixing elements are crimping elements.

5. The glazing panel as claimed in claim 1, wherein the pin of the coaxial cable is joined to the antenna by a lead-free solder material.

6. The glazing panel as claimed in claim 1, wherein the antenna is a wideband printed antenna.

7. The glazing panel as claimed in claim 1, wherein the shield is a metallic shield and the metallic shield is extended near an intermediate conductive element.

8. An electrically conductive connector, comprising:
- three mechanical fixing elements for maintaining a coaxial cable to the electrically conductive connector,
- an extended region for fixing mechanical fixing elements,
- one foot connected to the extended region for joining to an antenna by a solder material,
- wherein of the three mechanical fixing elements; first and second mechanical fixing elements are for electrical connection to a shield of the coaxial cable and a third mechanical fixing element is for fixing to an insulated layer of the coaxial cable.

9. The electrically conductive connector as claimed in claim 8, wherein the solder material is a lead-free solder.

10. The electrically conductive connector as claimed in claim 8, wherein the connector comprises two feet.

11. The electrically conductive connector as claimed in claim 8, wherein the mechanical fixing elements are fixed to at least one edge of the extended region of the electrically conductive connector.

12. A glazing panel comprising:
- a pane of glass,
- an antenna,
- an electrically conductive connector joined to the antenna, and
- a coaxial cable which comprises at least a pin and a shield separated by a dielectric element and an insulated layer covering the shield,
- wherein the electrically conductive connector further comprises
  - at least an extended region for fixing mechanical fixing elements,
  - at least one foot connected to the extended region for joining to the antenna, and
  - three mechanical fixing elements; first and second mechanical fixing elements electrically connected to the shield of the coaxial cable and a third mechanical fixing element fixed to the insulated layer of the coaxial cable.

13. The glazing panel as claimed in claim 12, wherein the electrically conductive connector comprises two feet.

14. The glazing panel as claimed in claim 12, wherein at least one foot has a rounded shape.

15. The glazing panel as claimed in claim 12, wherein the first and second mechanical fixing elements are fixed to opposite edges of the extended region of the electrically conductive connector.

16. The glazing panel as claimed in claim 12, wherein the mechanical fixing elements are crimping elements.

* * * * *